US006713010B1

(12) United States Patent
Doran et al.

(10) Patent No.: US 6,713,010 B1
(45) Date of Patent: Mar. 30, 2004

(54) SYSTEM FOR STRETCH-WRAPPING

(75) Inventors: Philip Doran, Dublin (IE); Alan Dunne, Dublin (IE)

(73) Assignee: Marmions, Limited, Dublin (IE)

( * ) Notice: Subject to any disclaimer, the term of this patent is extended or adjusted under 35 U.S.C. 154(b) by 0 days.

(21) Appl. No.: 09/719,963

(22) PCT Filed: Jun. 21, 1999

(86) PCT No.: PCT/IE99/00056

§ 371 (c)(1),
(2), (4) Date: Mar. 19, 2001

(87) PCT Pub. No.: WO99/65775

PCT Pub. Date: Dec. 23, 1999

(30) Foreign Application Priority Data

Jun. 19, 1998 (IE) ..... S980494

(51) Int. Cl.[7] ..... B29C 55/04; B65B 67/08
(52) U.S. Cl. ..... 264/289.6; 53/441
(58) Field of Search ..... 264/288.4, 288.6, 264/342 RE; 53/441; 428/220

(56) References Cited

U.S. PATENT DOCUMENTS 5,458,841 A * 10/1995 Shirrell ..... 264/289.6 X
5,797,240 A * 8/1998 Martin-Cocher et al. . 53/441 X

FOREIGN PATENT DOCUMENTS

| | | |
|---|---|---|
| AU | 20051/97 B | 11/1997 |
| EP | 0 081 328 A2 | 6/1983 |
| EP | 0 806 284 A1 | 11/1997 |
| FR | 27 48 722 A1 | 11/1997 |

* cited by examiner

*Primary Examiner*—Leo B. Tentoni
(74) *Attorney, Agent, or Firm*—Birch, Stewart, Kolasch & Birch, LLP

(57) ABSTRACT

The invention provides a wrapping system for stretch-wrap plastic film. Plastic film (25) is partially pre-stretched by a selected amount and then relaxed prior to winding on a core (14). The film (25) is subsequently further stretched as it is drawn from the core (14) immediately prior to wrapping a load on a pallet, for example. The partial pre-stretching is preferably carried out in a number of steps by leading film (25) from a roll (10) over three rollers (15, 16, 17) in turn. These rollers (15, 16, 17) are driven at different speeds, the third roller (17) having a greater speed than the second roller (16) which in turn has a greater speed than the first roller (15). Thus, the film (25) is stretched in three steps prior to relaxing the film (25) and winding the relaxed film (25) on a core (14). The core (14) can be mounted on a hand-held dispenser which applies the final stretch to the film (25).

17 Claims, 3 Drawing Sheets

SYSTEM FOR STRETCH-WRAPPING

This application is the national phase under 35 U.S.C. §371 of PCT International Application No. PCT/IE99/00056 which has an International filing date of Jun. 21, 1999, which designated the United States of America.

BACKGROUND OF THE INVENTION

1. Field of the Invention

This invention relates to a wrapping system for stretch-wrap plastic film and in particular linear low density polyethylene films.

2. Discussion of the Background

Stretch-wrap plastic film has been widely used for some time for wrapping and securing a load on a pallet for example. More recently the provision of a pre-stretched wrapping film has been proposed. The use of a pre-stretched wrapping film advantageously uses dramatically less material. The processes and apparatus for producing such a pre-stretched plastic film for wrapping have not however been entirely successful and such pre-stretched films have not gained widespread acceptance in use.

SUMMARY OF THE INVENTION

The present invention is directed towards providing an improved wrapping system for stretch-wrap plastic film which is simple and efficient to use.

According to the invention there is provided a wrapping system for stretch-wrap plastic film, comprising:

partially pre-stretching a plastics film by a desired amount, relaxing the film, and further stretching the partially pre-stretched film immediately prior to using the pre-stretched film for wrapping.

Advantageously the second stretching of the film immediately prior to application reactivates the memory of the plastic material causing shrinkage after application to firmly wrap and secure a load on a pallet for example.

In a preferred embodiment after relaxing the film, the film is wound on a core, the further stretching being carried out as the film is drawn from the core for use.

The ratio of the elongations of the film during the pre-stretching step and during the further stretching step is about 3:1.

In one embodiment of the invention the total stretching of the film is between 150% and 250%. Most preferably the total stretching of the film is about 200%.

Preferably the pre-stretching and relaxing elongates the plastics film by about 140–160% and the final stretching of the film immediately prior to application gives about a 15–20% further elongation of the pre-stretched film. It has been found that this controlled double stretching of the plastics film gives better results than the prior art in which the plastics film is fully stretched in one step.

In a preferred embodiment the pre-stretching of the plastics film is carried out in a number of steps. Ideally the pre-stretching is carried out in three steps giving in step 1 about 100% elongation, in step 2 about 30% elongation and in step 3 about 20% elongation.

In a further embodiment the film is stretched by feeding the film from a supply roll around two or more spaced-apart film stretching rollers, each roller rotating at a greater speed than the roll or roller immediately upstream to stretch the film between the rollers.

In a particularly preferred embodiment the pre-stretched film is loosely wound onto the core. This advantageously prevents collapse of the core due to the shrinkage in the film after winding. Preferably the film is loosely wound onto the core by feeding film off the final stretching roller at a speed greater than the speed at which the film is wound up on the core.

A further disadvantage with existing pre-stretched wrapping film systems is that when the film is pulled from the core for wrapping edge hang-ups tend to cut the film if it is drawn off the core at an angle which is often the case when wrapping a pallet or the like. Edge hang-ups are generated because the pre-stretched film is extremely thin and is not a problem generally with conventional stretch film. This problem can be overcome according to the invention by leading the film off the core whilst maintaining the line of take-off where the film parts from the core substantially parallel to the central rotational axis of the core. Thus the film is evenly drawn oft the core initially prior to application about the goods to be wrapped.

Preferably the film is drawn from the core around a take-off roller which rotatably engages against an outer surface of the core. This ensures that the film is evenly drawn from the core and it can be then applied at any desired angle onto the materials to be packaged downstream of the take-off roller.

In a preferred embodiment the final stretching of the film is carried out by leading the film from the core around a final stretch roller, the speed of the final stretch roller being greater than the speed of discharge of film from the core.

Conveniently the final stretch roller is drivably connected to the take-off roller through a gear drive which ensures rotation of the final roller at a desired speed greater than the take-off roller to achieve the desired final stretch of the film. Alternatively the final stretch roller may be geared to a rotational support for the core to achieve the same result.

In another aspect the invention provides a method for producing a partially pre-stretched plastics film for subsequent stretching and wrapping about a load.

BRIEF DESCRIPTION OF THE DRAWINGS

The invention will be more clearly understood by the following description of some embodiments thereof, given by way of example only, with reference to the accompanying drawings, in which.

DISCUSSION OF THE PREFERRED EMBODIMENTS

Figure 1:
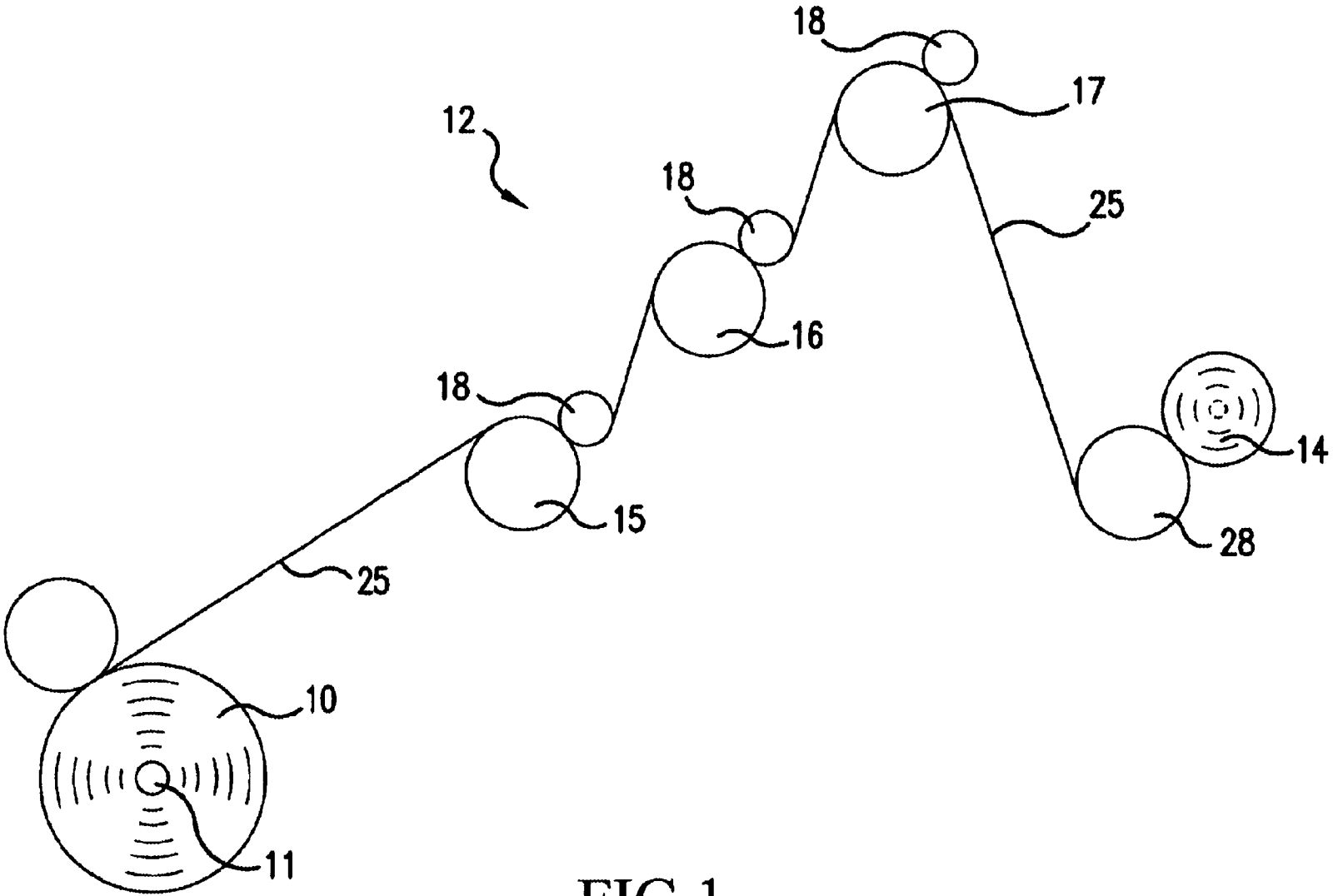
FIG. 1 is a schematic illustration of apparatus for partially pre-stretching plastics film according to the invention.
Figure 2:
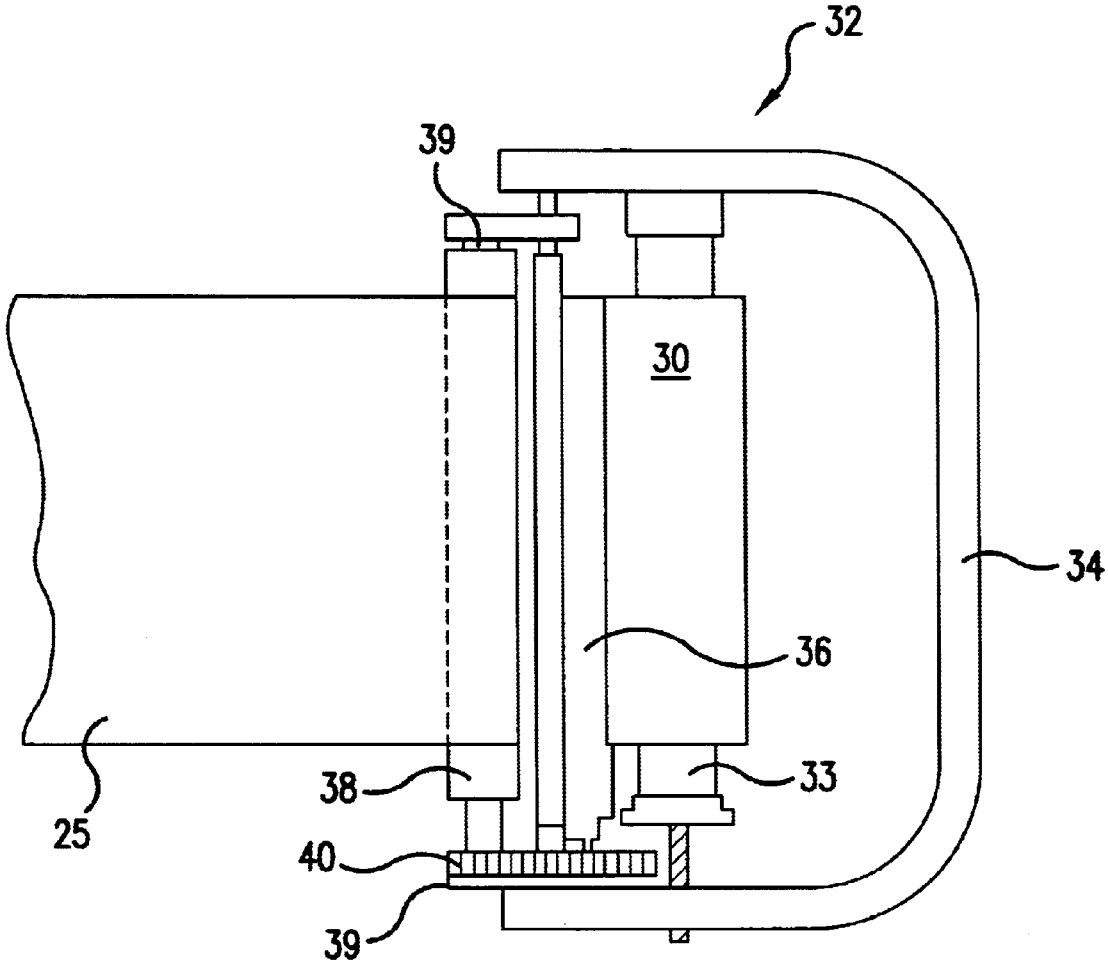
FIG. 2 is perspective view of a hand-held film applicator for applying a secondary stretch to the film immediately prior to wrapping an object with the film.

Referring to the drawings, a system for producing pre-stretched plastic wrapping film will be described. A plastic film 25 is produced in conventional fashion and wound up on a roll 10. The roll 10 is rotatably mounted on a support 11 and film 25 is delivered through film stretching apparatus 12 to pre-stretch the film 25 by a desired amount prior to winding up the pre-stretched film 25 on a core 14.

The film stretching apparatus 12 comprises a set of stretching rollers, in this case comprising three rollers, namely a first roller 15, second roller 16 and third roller 17. Each roller 15,16,17 has an associated idler roller 18 to guide the film about the roller 15, 16, 17 in frictional engagement with the roller 15,16,17. The rollers 15,16,17 are driven at different speeds, the third roller 17 having a greater speed than the second roller 16 which in turn has a greater speed than the first roller 15. Thus the first roller 15 applies a stretch of about 100% to the film, the second roller 16 further stretches the film by about 30% and the third roller 17 further stretches the film by about 20%. In this way the plastics film 25 is pre-stretched in three steps prior to winding up on the core 14.

The film 25 is loosely wound up on the core 14 to allow for subsequent shrinkage of the film 25. To achieve this a take-off roller 28 downstream of the stretching apparatus 12 rotates at a speed slightly less than the speed of the third stretching roller 17.

For wrapping objects with the film 25 a pre-stretched film roll 30 is mounted on a hand-held dispenser 32 the roll 30 being rotatably mounted on a support 33 carried on a handle 34. Also mounted on the handle 34 are a pair of rollers, namely a take-off roller 36 and a final stretch roller 38. The rollers 36,38 are mounted between support brackets 39. At one end of the rollers 36,38 the rollers 36,38 are interconnected by a gear drive 40 which ensures rotation of the final stretch roller 38 at a desired speed greater than the take-off roller 36 to achieve the desired final stretch of the film 25 as it is drawn from the roll 30.

In use, an operative grips the handle 34. Having attached a free end of the film 25 to the object to be wrapped the operative walks around the object drawing film 25 off the roll 30 and applying it around the object. As the film 25 is drawn from the roll 30 it is given the final stretch between the take off roller 36 and the final stretch roller 38 prior to application to the object to reactivate the memory of the plastic material so that the film will subsequently shrink onto the object securely wrapping and gripping the object. It will be noted that the film 25 is led from the roll 30 around the take-off roller 36 which engages against the roll 30 to maintain the line of take-off where the film 25 parts from the roll 30 substantially parallel to the central rotational axis of the roll 30. Thus the film 35 is evenly drawn from the roll 30 without damage due to hang-ups at the edge of the roll 30.

It will be appreciated that the system of the invention applies a desired optimum stretch to the film and it can be easily used by even an unskilled operative to wrap an object.

It will be appreciated also that while a hand-held dispenser is particularly convenient to use the system may be used with an automatic wrapping device if desired.

Figure 3:
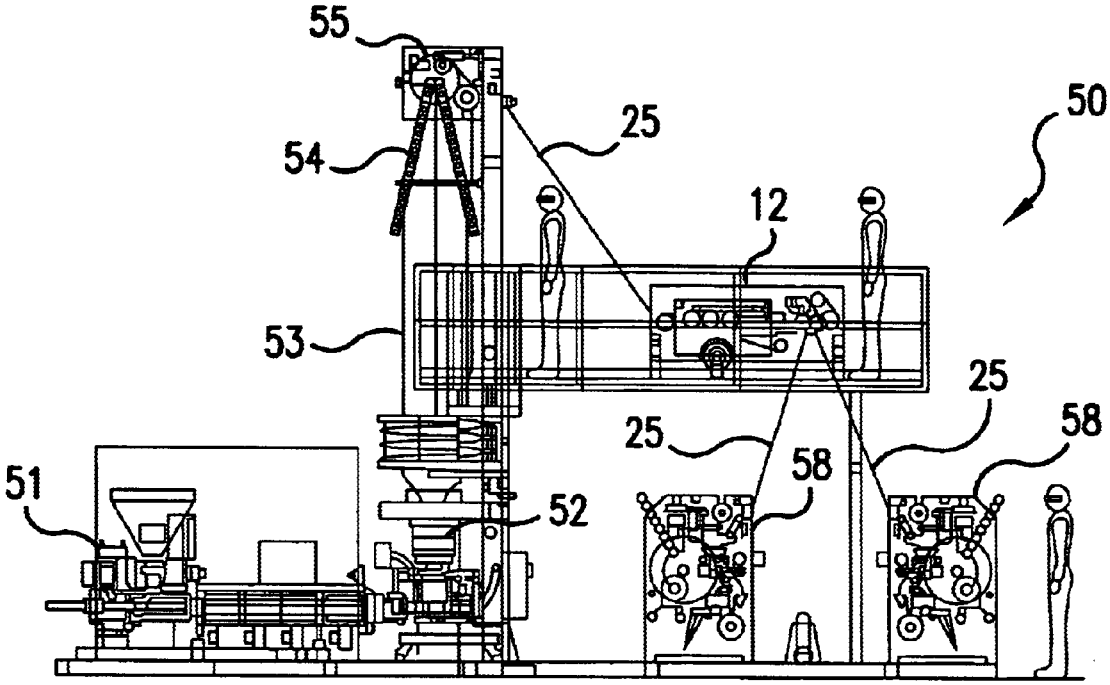
FIG. 3 is an elevational view of apparatus for producing pre-stretched film according to the invention.
Figure 4:
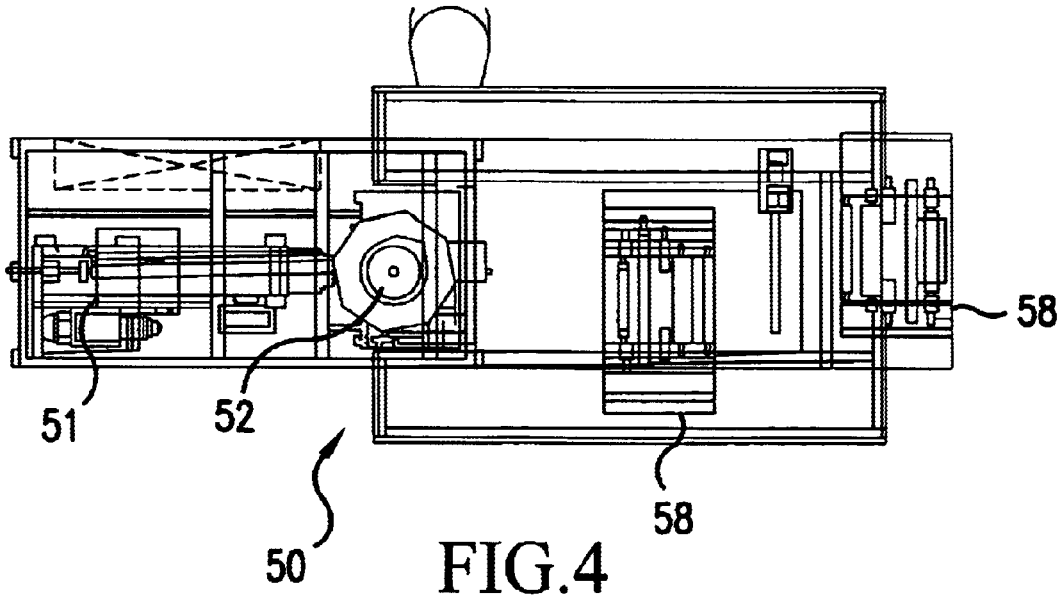
FIG. 4 is a plan view of the apparatus.

Referring now to FIGS. 3 and 4 there is shown apparatus for producing rolls of partially stretched film according to the invention, the apparatus being indicated generally by the reference numeral 50. The apparatus 50 comprises a conventional extruder 51 and associated die assembly 52 for forming plastics film in a bubble configuration 53 as it is delivered up from the die 52. A conventional collapsing device 54 collapses the bubble 53 which is then delivered through a pair of nip rollers 55 to form the flat film 25 which is then delivered to the stretching apparatus 12. It will be noted that the bubble 53 is collapsed into essentially two overlapping sheets joined at their edges. Also, the temperature of the plastics material at the nip rollers is sufficiently hot to allow blocking or fusing together of said sheets to form a composite fused flat film 25. The film 25 is then delivered through the stretching apparatus 12 in which the film is partially stretched by about 200% overall in three stages as previous described. Downstream of the stretching apparatus 12, the partially stretched film is fed to a core winder 58 in which the partially stretched film is relaxed by about 25% before being wound up on a core as previously described. Two core winders 58 are shown in the drawing. The film 25 may be split longitudinally as shown in FIG. 4 at an outlet of the stretching apparatus 12 to form two narrower films 25 which are then wound up on the separate core winders 58 if desired.

It will be appreciated that any other method and apparatus may be employed for forming the flat plastics film which is subsequently delivered to the stepped stretching apparatus 12.

The invention is not limited to the embodiments hereinbefore described which may be varied in both construction and detail within the scope of the appended claims.

What is claimed is:

1. A wrapping system for stretch-wrap plastic film, comprising:

partially pre-stretching a plastics film by a desired amount, relaxing the film, and further stretching the partially pre-stretched film immediately prior to using the pre-stretched film for wrapping.

2. A wrapping system as claimed in claim 1 wherein after relaxing the film, the film is wound on a core, the further stretching being carried out as the film is drawn from the core for use.

3. A wrapping system as claimed in claim 1 wherein the ratio of the elongations of the film during the pre-stretching step and during the further stretching step is about 3:1.

4. A wrapping system as claimed in claim 1, wherein the total stretching of the film is between 150% and 250%.

5. A wrapping system as claimed in claim 4, wherein the total stretching of the film is about 200%.

6. A wrapping system as claimed in claim 1, wherein the pre-stretching and relaxing elongates the plastics film by about 140–160% and the final stretching of the film immediately prior to application gives between a 10% and 50% elongation of the film.

7. A wrapping system as claimed in claim 1, wherein in the pre-stretching step, the film is stretched by about 200%, said stretched film being subsequently relaxed by about 50%, and in the final stretch the film is stretched by about 50%.

8. A wrapping system as claimed in claim 1 wherein the pre-stretching of the plastics film is carried out in a number of steps.

9. A wrapping system as claimed in claim 8, wherein the pre-stretching is carried out in three steps giving in step 1 about 100% elongation, in step 2 about 30% elongation and in step 3 about 20% elongation.

10. A wrapping system as claimed in claim 1, wherein the film is stretched by feeding the film from a supply roll around two or more spaced-apart film stretching rollers, each roller rotating at a greater speed than the roll or roller immediately upstream to stretch the film between the rollers.

11. A wrapping system as claimed in claim 1, wherein the pre-stretched film is loosely wound onto the core.

12. A wrapping system as claimed in claim 11, wherein the film is loosely wound onto the core by feeding film off the final stretching roller at a speed greater than the speed at which the film is wound up on the core.

13. A wrapping system as claimed in claim 1 which includes the step of leading the film off the core whilst maintaining the line of take-off where the film parts from the core substantially parallel to the central rotational axis of the core.

14. A wrapping system as claimed in claim 13, which includes drawing the film from the core around a take-off roller which rotatably engages against an outer surface of the core.

15. A wrapping system as claimed in claim 1, wherein the final stretching of the film is carried out by leading the film from the core around a final stretch roller, the speed of the final stretch roller being greater than the speed of discharge of film from the core.

16. A wrapping system as claimed in claim 15, wherein the final stretch roller is drivably connected to the take-off roller through a gear drive which ensures rotation of the final roller at a desired speed greater than the take-off roller to achieve the desired final stretch of the film.

17. A wrapping system as claimed in claim 15, wherein the final stretch roller is geared to a rotational support for the core.

* * * * *